United States Patent [19]

Nelson

[11] 4,365,451

[45] Dec. 28, 1982

[54] POURED ADOBE BUILDING CONSTRUCTION AND METHOD OF FORMING SAME

[76] Inventor: Lynn S. Nelson, 162 Christen Dr., Pacheco, Calif. 94553

[21] Appl. No.: 110,362

[22] Filed: Jan. 8, 1980

[51] Int. Cl.[3] ..... E02D 27/00

[52] U.S. Cl. ..... 52/169.9; 52/293; 52/742

[58] Field of Search ..... 52/169.1, 169.5, 169.8, 52/169.9, 310, 742, 293, 297; 264/86; 249/113

[56] References Cited

U.S. PATENT DOCUMENTS

| | | | |
|---|---|---|---|
| 399,064 | 5/1889 | McLean | 249/113 |
| 1,399,977 | 12/1921 | Merle | 249/113 |
| 1,655,676 | 1/1928 | Daggett | 52/169.1 |
| 1,684,624 | 9/1928 | Hayden | 249/113 |
| 1,848,357 | 3/1932 | Kotrhaty | 52/293 |
| 2,138,683 | 11/1938 | Weesner | 52/310 |
| 2,388,679 | 11/1945 | Davis | 52/169.1 |
| 2,496,616 | 2/1950 | Barton | 52/293 |
| 2,625,729 | 1/1953 | Ingalls | 52/310 |
| 3,498,015 | 3/1970 | Seaburg | 52/310 |
| 3,545,155 | 12/1970 | Church | 52/169.1 |
| 4,221,090 | 9/1980 | Pahl | 52/297 |

FOREIGN PATENT DOCUMENTS

| | | | |
|---|---|---|---|
| 641896 | 12/1960 | Italy | 52/742 |

OTHER PUBLICATIONS

*Handbook for Building Homes of Earth,* by Department of Housing and Urban Development, pp. 24 and 25, Arc No. 691.4 W855.

*Primary Examiner*—Price C. Faw, Jr.
*Assistant Examiner*—Henry E. Raduazo

[57] ABSTRACT

Heretofore, commercial adobe construction has involved bricks or blocks of adobe (a sand and clay mixture prevalent in Western United States). In accordance with this invention, foundation footings of concrete are poured with the lower edges of wire mesh reinforcing material embedded or in otherwise attached to the horizontal foundation beams, one adjacent to each face of the adobe wall to be constructed. Since the adobe walls do not accommodate vertical bearing loads, holes are dug in the earth at spaced intervals to receive reinforcing bar cages and the lower ends of posts which carry the roof load. After the foundation has set, modular forms are applied along either face of the wall and interconnected, preferably by snap ties. Each form has a frame around four edges and vertical members spaced between the vertical edge members, all preferably of 2×4's. The inner face of each form carries a diamond pattern expanded metal member. Adobe (preferably dug from the site) is pre-soaked (if necessary), in water in a pit, then mixed with coarse sand (if necessary to obtain preferred soil mix of 25–45% clay and the rest sand) in a plastic mixture along with a waterproof emulsifier (asphalt), straw and water to a suitable viscosity and then poured or pumped between the forms. The excess water seeps through the expanded metal so that in about two weeks, in warm weather, the wall sets. The forms are removed by breaking the snap ties. Adobe smooth plaster coats the walls.

9 Claims, 6 Drawing Figures

POURED ADOBE BUILDING CONSTRUCTION AND METHOD OF FORMING SAME

This invention relates to a new and improved poured adobe building construction and method of forming same.

Adobe construction has long been recognized as a desirable building technique but has been used in modern times only to a limited extent. The present invention provides a construction and method of forming same which is practical for modern building construction methods.

Thus, adobe construction, which is beautiful and fits into natural surroundings, and which also provides the heat storage capacity required in passively solar-heated homes, may be made on a commercially practical, large scale construction technique.

One of the features of adobe construction which is preserved in accordance with the present invention is the use to a large extent of materials available on the building site. Thus, the use and cost of lumber and other conventional materials is substantially reduced. Furthermore, the transportation of such materials from a lumber mill or factory to the site is reduced.

An advantage of the present invention over other adobe construction methods is that it is considerably less labor-intensive, a factor which has deterred prior use of adobe except by individuals and families constructing their own adobe or by those able to afford the high cost of contracted block adobe.

Another feature of the invention is the use of post and beam construction which is earthquake resistant because the adobe walls do not bear vertical load.

Another feature of the invention is the fact that mechanized equipment may be used in the construction.

A still further feature of the invention is the optional provision of insulation inside the adobe walls.

Other objects of the present invention will become apparent upon reading the following specification and referring to the accompanying drawings in which similar characters of reference represent corresponding parts in each of the several views.

Figure 3:
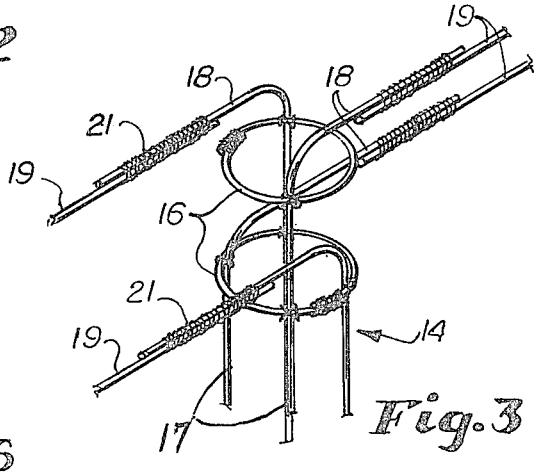
FIG. 3 is a perspective view of a portion of the concrete reinforcing members.
Figure 5:
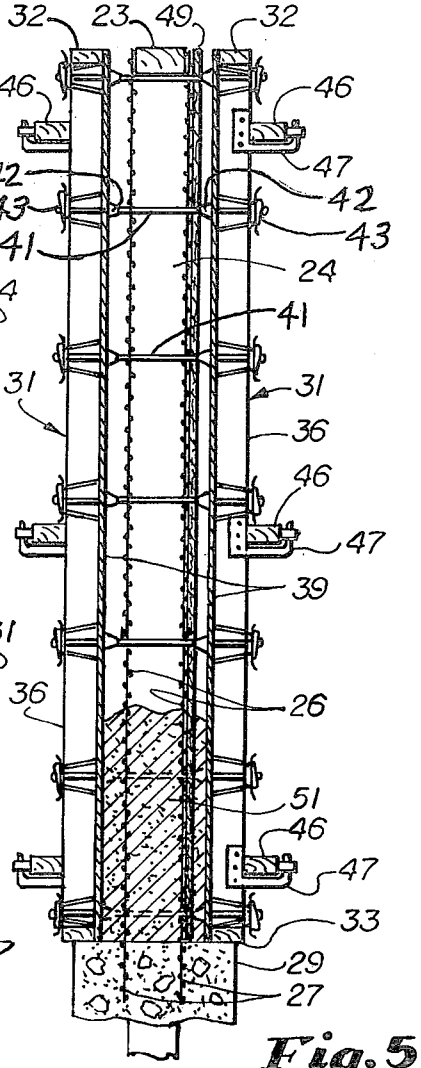
FIG. 5 is a sectional view taken substantially along the line 5—5 of FIG. 4.

Preliminary to the erection of forms, a trench 13 is dug, preferably down to bedrock 11. One of the desirable features of the invention is the fact that the material excavated for the trench 13 is usually adobe and may be used in the construction of the wall. At about 12 foot centers, holes 12 of about 20″ diameter and approximately 5′4″ deep are bored, the material excavated again being used in wall construction. Particularly to satisfy earthquake safety standards, the foundation is well reinforced. Thus a reinforcing cage 14 is installed in each hole 12, preferably being about 14″ in diameter consisting of vertically spaced apart horizontal bands 16 and vertical reinforcing bars being installed at each of four corners. Preliminary to installation of cage 14 a thin layer of concrete may be poured into the bottom of hole 12 and allowed to set. Small rocks may be dropped into the holes to keep the ends of posts 24 from resting in water which later may seep into the hole. The bars 17 are bent in horizontal stretches above the ground and are connected to intermediate horizontal stretches between the holes 12 by means of conventional ties 21. The tieing of the reinforcing bars, which are preferably of No. 4 reinforcing bar stock, is best shown in FIG. 3.

To support horizontal beams 23 (which are preferably 6″×8″ in cross section), vertical posts 24 are installed in the holes 12. Posts 24 are sized with respect to a lateral force analysis of the building, preferably 8″ square wood which have previously been pressure treated with copper naphthanate. The posts 24 are initially braced so that they are properly vertically and horizontally aligned.

Figure 1:
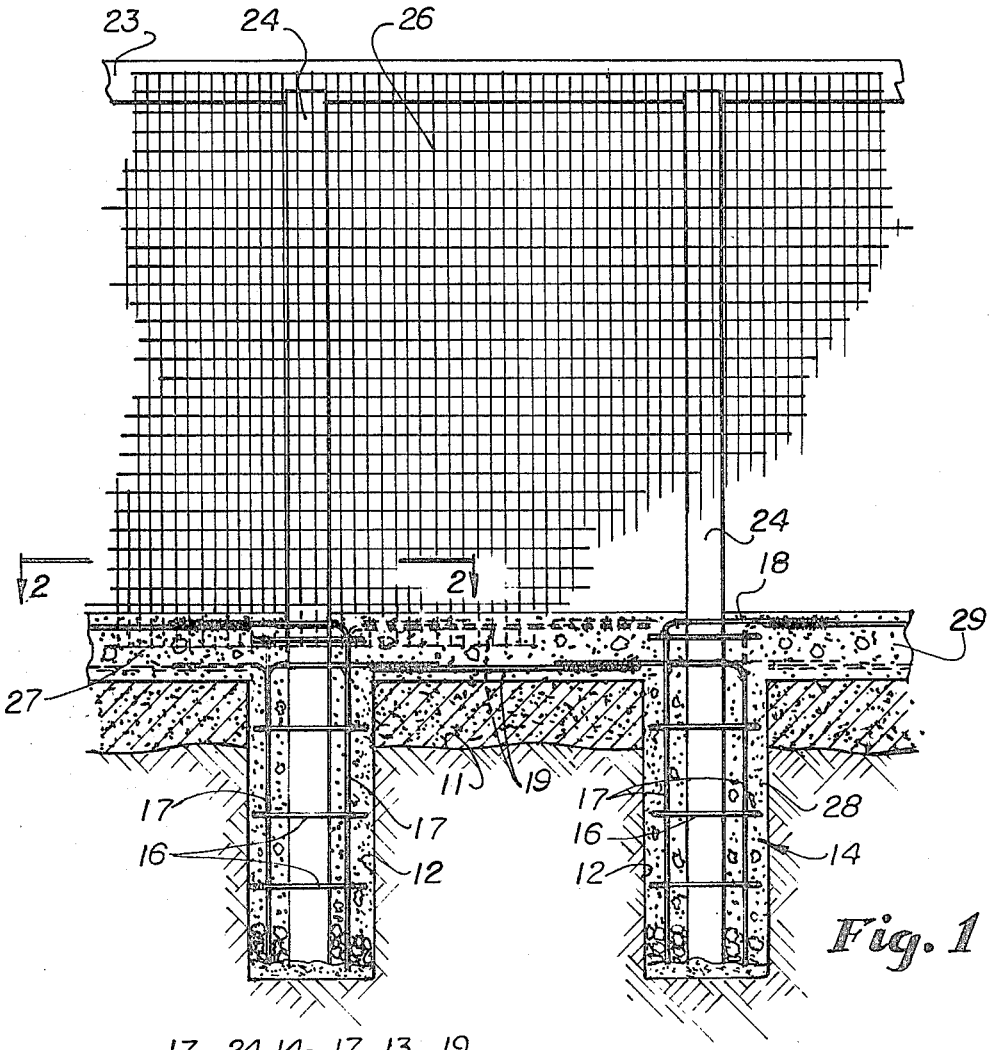
FIG. 1 is a vertical sectional view through a portion of the reinforcing materials for an adobe wall.
Figure 2:
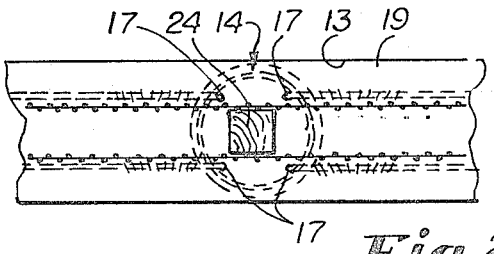
FIG. 2 is a sectional view taken substantially along the line 2—2 of FIG. 1.

Welded wire mesh reinforcing 26, preferably about 12 gauge, is nailed by means of galvanized nails to the inside and outside faces of the posts 24. It is very desirable that approximately the bottom 9″ 27 of the reinforcing material 26 be embedded in the foundation, as shown in FIG. 1. Concrete 28 is then poured to fill the holes 12 and also to form a 12″×12″ foundation beam 29 inside the trench 13, all by the use of standard concrete forms and techniques well understood in the building art. The foundation is allowed to set and partially cure.

In a preferred practice of the invention, modular forms 31 are employed, the forms preferably being 4′ wide and 8′ high (or whatever ceiling height is desired). The framework of the forms 31 is preferably of 2×4 wood members consisting of top 32, bottom 33 and vertical edges 34. For a 4′ width, preferably two equally spaced intermediate vertical members 36 are used. The meeting edges of adjacent forms 31 are fastened together by nuts and bolts 37 at appropriate intervals.

Nailed to the inside of each form 31 is a sheet of diamond-shaped expanded metal 39, a preferred expanded metal being No. 13.

Figure 4:
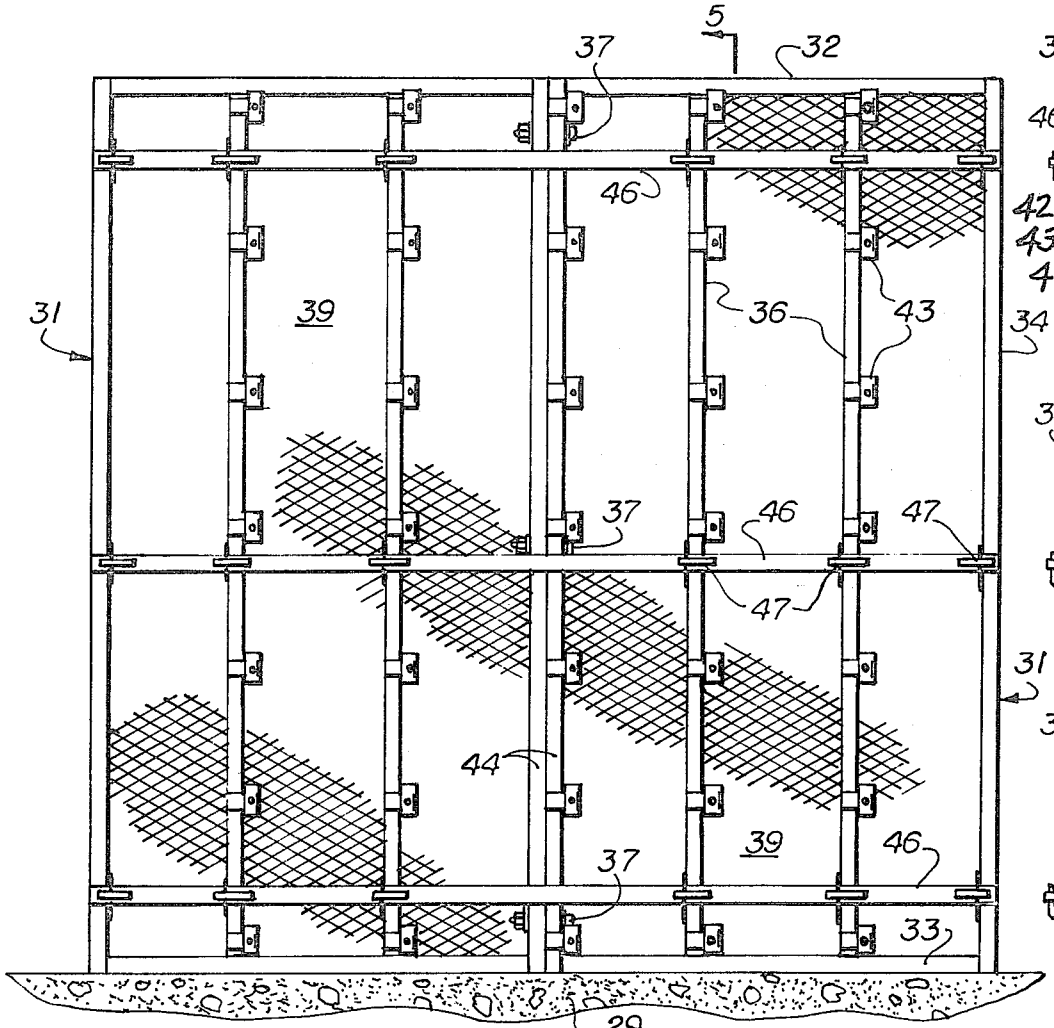
FIG. 4 is a side elevational view of two modular form sections.

It is understood that the forms 31 are reuseable repeatedly. In a preferred construction, snap ties 41 are installed spacing the forms 31 apart. The pattern of snap ties shown in FIG. 4 is preferable, there being a vertical row of such ties along one side of each vertical 2×4. Seven equally vertically spaced apart ties for each 2×4 is preferable. The ties 41 are of a type commonly used in concrete construction. One suitable snap tie is known as Burke Architectural Penta-Tie such as that shown in Utility U.S. Pat. No. 3,783,462 and Design U.S. Pat. No. 229,538. Such ties have braces 42 which fit against the wire mesh 26. On the exterior of the mesh are snap brackets 20 such as those shown in U.S. Pat. No. 3,128,524.

To maintain the forms straight, at least three horizontal stiffeners 46, which are also made of 2×4's, may be positioned on the outside of the vertical members 34 and 36 and are held in place by liner clamps which function as holding brackets 47.

As a further optional feature, insulation material may be fastened on the exterior of the mesh 26 or to the exterior of the adobe wall when the forms are removed. A rigid board styrofoam insulation 1″ or 2″ thick may be secured to the mesh if heat insulation is desired.

Adobe 51, prepared as hereinafter described, fills the space between the forms.

Figure 6:
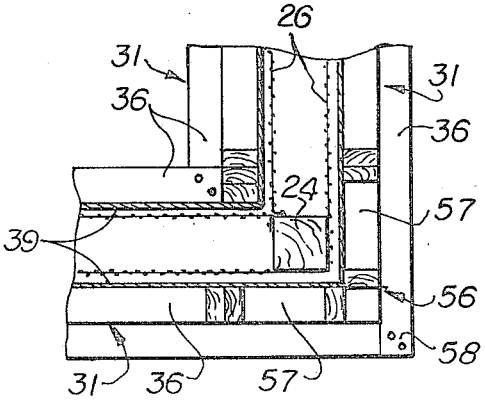
FIG. 6 is a fragmentary horizontal sectional view through the forms for a corner of a wall.

Directing the attention now to FIG. 6, at the corners where the modular forms 31 meet, corner extensions 57 are added secured to the stiffeners 46 and joined together by joints 58.

Preparation of the adobe is an important feature of the present invention. The adobe is preferably dug from the site and, if necessary, presoaked in a pit dug in the ground adjacent the building (such as the excavation for a swimming pool). A back hoe may be used to dig the adobe and also to dig the trenches 13. Whether presoaked or not, the adobe is loaded into a plaster mixer, a mechanical mixer having paddles as distinguished from a standard cement mixer. The mix consists of sand in the proportion of three parts sand to one part clay, approximately two gallons of waterproof emulsified asphalt per four cubic foot of sand and adobe mix, and about ten pounds of straw per half cubic yard of adobe mix. Depending upon the proportions of clay and sand found in the on-site earth, more clay or sand can be added until the mix reaches the preferred proportions of 25–45% clay and the rest sand. Coarse sand is required to reduce cracking in the adobe during curing. Water is added to achieve a slurry of suitable viscosity for pumping. The mix is turned in a plaster mixer for about ten minutes for a load of about one-half cubic yards. Alternatively, the adobe can be conveyored into a cement truck and the other ingredients added and mixed there.

Preferably, the mixed adobe is dumped into a hopper and mixed with subsequent loads for uniformity and then pumped by means of a mechanical pump (such as a Mayco Concrete Pump with a 2" hose line), into the space between the forms 31. Alternatively, a front loader may be used to transport the material from the plaster mixer to the forms and dumped from the front loader into the forms.

Water in the forms seeps through the expanded metal. To prevent over-rapid evaporation at the top of the wall, damp cloths may be used as a protection. In reasonably warm weather, the forms may be removed within two weeks. This is done by breaking the snap ties 41 in accordance with conventional reinforced concrete practice.

The walls may be finished by installing the horizontal beams 23 and then smoothing the interior and exterior with plaster, preferably smooth adobe plaster.

What is claimed is:

1. In combination, a poured adobe building having a foundation, a plurality of vertical, longitudinally spaced posts extending up from said foundation, having inner and outer faces, said posts being substantially centrally located relative to the inside and outside of said wall, inner and outer removable, reusable forms on opposite sides of said wall spaced outwardly of said inner and outer faces, severable tie means securing said forms aligned and accurately spaced apart, said forms having sheets of porous material to permit escape of water from between the forms, said porous material being removable with said forms, and a slurry of adobe, filler material and water poured between said forms, said foundation comprising concrete formed in a trench along the wall and in holes dug at intervals along said trench, the lower ends of said posts fitting into said holes.

2. A construction unit according to claim 1 in which reinforcing bar cages are embedded in the concrete in said holes surrounding said posts, said cages having vertical bars in said holes bent above said holes in horizontal stretches to extend along said trench, horizontal intermediate reinforcing bars in said trench between said posts and ties securing said horizontal stretches to ends of said intermediate bars.

3. A combination according to claim 1 which further comprises vertical, longitudinally extending reinforcing material secured to opposite sides of said posts, parallel to and spaced inward of said forms.

4. A combination according to claim 1 in which each said form comprises a sheet of diamond shaped expanded metal.

5. A combination according to claim 1 in which said tie means comprises snap ties.

6. A combination according to claim 1 in which each said form comprises a modular unit having frame members around four sides and vertical intermediate frame members, said sheet located on the inside of said unit.

7. A combination according to claim 1 in which said slurry comprises clay, sand and straw.

8. A construction unit according to claim 7 in which the proportions of said slurry are: approximately 1 part clay and 3 parts sand and approximately 10 lbs. straw per cu. ft.

9. A construction unit according to claim 7 in which said slurry further comprises an asphalt emulsifier waterproofer.

* * * * *